US007958824B2

(12) United States Patent
Stewart

(10) Patent No.: US 7,958,824 B2
(45) Date of Patent: Jun. 14, 2011

(54) SECURITY ENHANCED BLASTING APPARATUS, AND METHOD OF BLASTING

(75) Inventor: Ronald F. Stewart, Navan (CA)

(73) Assignee: Orica Explosives Technology Pty Ltd., Melbourne, Victoria (AU)

( * ) Notice: Subject to any disclaimer, the term of this patent is extended or adjusted under 35 U.S.C. 154(b) by 0 days.

(21) Appl. No.: 12/958,613

(22) Filed: Dec. 2, 2010

(65) Prior Publication Data

US 2011/0067591 A1 Mar. 24, 2011

Related U.S. Application Data

(62) Division of application No. 11/354,929, filed on Feb. 16, 2006.

(60) Provisional application No. 60/653,085, filed on Feb. 16, 2005, provisional application No. 60/715,133, filed on Sep. 9, 2005.

(51) Int. Cl.
*F42B 3/00* (2006.01)

(52) U.S. Cl. ..... 102/301; 102/200

(58) Field of Classification Search ..... 102/301, 102/200, 306, 215; 361/248, 251
See application file for complete search history.

(56) References Cited

U.S. PATENT DOCUMENTS

| | | | |
|---|---|---|---|
| 4,576,093 | A | 3/1986 | Snyder |
| 4,725,991 | A | 2/1988 | Crenwelge, Jr. et al. |
| 4,934,269 | A | 6/1990 | Powell |
| 4,976,199 | A | 12/1990 | Beukes et al. |
| 5,214,236 | A | 5/1993 | Murphy et al. |
| 5,369,579 | A | 11/1994 | Anderson |
| 5,520,114 | A | 5/1996 | Guimard et al. |
| 5,539,636 | A | 7/1996 | Marsh et al. |
| 5,689,420 | A | 11/1997 | Brewster |
| 5,812,252 | A | 9/1998 | Bowker et al. |
| 5,937,557 | A | 8/1999 | Bowker et al. |
| 6,079,333 | A | 6/2000 | Manning |
| 6,098,330 | A | 8/2000 | Schmitt et al. |
| 6,219,439 | B1 | 4/2001 | Burger |
| 6,422,147 | B1 | 7/2002 | Shann |
| 6,636,621 | B2 | 10/2003 | Thebaud |
| 6,644,202 | B1 | 11/2003 | Duniam et al. |
| 6,851,369 | B2 | 2/2005 | Hummel et al. |
| 6,941,870 | B2 | 9/2005 | McClure et al. |
| 7,370,583 | B2 | 5/2008 | Bokvist et al. |
| 2002/0088620 | A1 | 7/2002 | Lerche et al. |
| 2003/0167153 | A1 | 9/2003 | Alexander |

(Continued)

FOREIGN PATENT DOCUMENTS

AU 198778265 4/1988

(Continued)

OTHER PUBLICATIONS

Resource and Asset Management: Bell GoTrax™; http://www.businessonthego1.com/english/ws_dataapplications_resource_gotrax.asp (2006).

(Continued)

*Primary Examiner* — Michael Carone
*Assistant Examiner* — Jonathan C Weber
(74) *Attorney, Agent, or Firm* — Nixon & Vanderhye P.C.

(57) ABSTRACT

Blasting apparatuses are disclosed that include enhanced security features, including biometric analysis of specific biological features of a candidate blast operator, thereby to generate a biometric signature. Other corresponding methods relate to cross-referencing of biometric signatures between components of the blasting system. Additional security features of the blasting apparatuses, and corresponding methods of blasting employing the blasting apparatuses, are also disclosed.

9 Claims, 6 Drawing Sheets

U.S. PATENT DOCUMENTS

| | | | |
|---|---|---|---|
| 2004/0080411 | A1 | 4/2004 | Renfro |
| 2004/0129787 | A1 | 7/2004 | Saito et al. |
| 2004/0225431 | A1 | 11/2004 | Aebi et al. |
| 2005/0000382 | A1 | 1/2005 | Hummel et al. |
| 2005/0103219 | A1 | 5/2005 | McClure et al. |
| 2005/0252403 | A1 | 11/2005 | DeVries et al. |
| 2006/0027121 | A1 | 2/2006 | Koekemoer et al. |

FOREIGN PATENT DOCUMENTS

| | | |
|---|---|---|
| CA | 2423936 | 3/2003 |
| DE | 10356349 | 6/2005 |
| EP | 897098 | 2/1999 |
| FR | 2725782 | 4/1996 |
| GB | 2385343 | 9/2004 |
| WO | 92/08932 | 5/1992 |
| WO | 95/26013 | 9/1995 |
| WO | 99/24776 | 5/1999 |
| WO | 00/60305 | 10/2000 |
| WO | 00/63636 | 10/2000 |
| WO | 01/20538 | 3/2001 |
| WO | 03/098537 | 11/2003 |
| WO | 2005/008169 | 1/2005 |
| WO | 2005/052498 | 6/2005 |
| WO | 2006/010172 | 1/2006 |

OTHER PUBLICATIONS

Sony FIU-700 Biometric Unit Designated Entrust-Ready™ http://www.entrust.com/news/files/05_02_00_294.htm (2004).

Navigating the wireless world—Nathan Pugh et al. http://www.pobonline.com/CDA/ArticleInformation/Article/1,9169,124028,00.html (2005).

Enhanced 911—Wireless Services http://www.fcc.gov/911/enhanced/ (2005).

Sensing and Sensors *L2005-11B-vapor sniffing-jauwaert-01* (2005).

Does my cell phone company keep track of me wherever I go?, www.straightdope.com/columns/020215.htm (2005).

The Post Online www.thepost.ohiou.edu/N.php?article=N2&date=052504 (2005).

A framework for location privacy in wireless networks—Yin-Chun Hu http://research.microsoft.com/~helenw/papers/sigasia05.pdf#search=%22A%20framework%20for%20location%20privacy%20in%20wireless%20networks%22 (2005).

Security Intelligence Technologies—Cellular Intercept (GSM) http://www.spyzone.com/dProductDetail.aspx?productID=889&selection=0 (2005).

Bomb Jammer http://www.bombjammer.com (2005).

Hope you like jamming, too http://www.slate.msn.com/id/2092059 (2005).

Global Gadget—Advanced Electronic Suppliers http://www.globalgadgetuk.com/cell%20phone%20jammers.htm (2005).

Netline—(several web pages) http://www.netline.co.il/Netline/ (2005).

Improvised Explosive Devices (IEDs) and Convoy Protection http://security.lifesafety.ca/2004articles/2004sec0048.htm (2005).

Cell can work as a remote http://www.busrep.co.za/general/print_article.php?ArticleId=2508186&fSectionId=552&fSetId=304 (2005).

Sensors—Sep. 2004—Reality Mining: Browsing Reality with Sensor Networks http://sensoremag.com/articles/0904/14/main.shtml (2005).

GPS Cell Phone Tracking www.accutracking.com/ (2005).

PC World.com—Dialed In: GPS Cell Phones http://www.pcworld.com/reviews/article/0,aid,115273,00.asp (2005).

ZDNet.News—Cell phone flaw opens security hole http://www.snapshield.com/Articles_helpful/Cell_phone_flaw.htm (2005).

Localization technologies http://www.cs.huji.ac.il/course/2004/postPC/docs/Localization_2003.pdf (2005).

Spotlight / Pervasive Computing: Challenges in Location-Aware Computer http://john.cs.olemiss.edu/~gfan/ENGR691/Readings/Patt03-IEEE-Pervasive.pdf#search=%22Spotlight%2BPervasive%2BComputing%2Bchallenges%2Blocation%22 (2005).

Tracker Tagging System—System overview http://www.minesite.com.au/category/category.asp?categoryid=4&childid=9 (2005).

Blackhawk Geometrics & GEOVision Case Histories Blast Monitoring—Blast Monitoring http://www.cse.psu.edu/~swankosk/01203757.pdf (2005).

Mining Weekly—"Three new blasting technologies to increase safety and efficiency", http://www.miningweekly.co.za/min/features/explosive/?show=26859 (2005).

Mining Weekly—"Digital blast—control network installed in 12 SA mines in the last 12 months", http://www.miningweekly.co.za/min/features/future/?show=34007 (2005).

Mining Weekly—"New tech links pyrotechnic blasting and electronic blast control"; http://www.miningweekly.co.za/min/features/explosive/?show=32495 (2005).

DetNet's HotShot—Next Generation Electronic Detonation http://www.inhandelectronics.com/detnet.asp (2005).

Evaluation of electronic detonators—requirements for shunting & circuit testing http://www.msha.gov/TECHSUPP/ACC/techreports/ShuntingCircuitTesting.pdf (2005).

The Network Control Revolution in Underground Rock Breaking—A J Bizos http://www.explosives.co.za/pdf/blastingnews/nov04blastnews.pdf (2005).

Austdac—Long-Distance Data transmission, Communication, Monitoring and Control System (several websites) http://www.mining-technology.com/company_printable.asp?ProductsSubGroupID=1010&CompanyID=27756 http://www.mining-technology.com/company_printable.asp-?ProductsSubGroupID=1002&CompanyID=27470 http://www.mining-technology.com/company_printable.asp?ProductsSubGroupID=1002&CompanyID=27755 http://www.mining-technology.com/company_printable.asp?ProductsSubGroupID=1002&CompanyID=5883 http://www.mining-technology.com/company_printable.asp?ProductsSubGroupID=1002&CompanyID=26973 http://www.mining-technology.com/contractors/communications/minecom/ (2005)6.

Daveytronic—Digital Blasting Detonation http://www.daveytronic.com/friendly.htm (2005).

Plugging in to Digital Detonation http://rockproducts.com/mag/rock_plugging_digital_detonation/ (2005).

DetNet—Electronic Detonator Systems / Blast Control Networks and DetNet Solutions http://www.detnet.com/technology_products/existing.html *and* http://www.explosives.co.za/content/news/blastingnews/october2002/detnet.asp (2005).

AEL News—Blasting technology refined http://www.explosives.co.za/content/news/whatsnew/technologyrefined.asp (2005).

Explosive growth delivered by Linux http://www.explosives.co.za/linux/view/linux/en/page12994?oid=12282&sn=Detail (2005).

Boomerang Tracking www.boomerangtracking.com/en/faq/faq.asp (2005).

Routing and topology repair for Ad Hoc Mobile Networks using highly directional Wireless media—Vandereen K et al. http://www.geocities.com/vandervn/TopologyRepair.pdf (2005).

Orica Explosives new technology trails deliver results http://www.orica.com.au/BUSINESS/COR/orica/COR00254.NSF/Page/New_Orica_Explosives'_New_Technology_Trials_Deliver_Results (2005).

Orica News http://www.oricaminingservices.com/files/mediaroom/94/1/Orica%20News%20-%20Final%20proof.pdf (2005).

Wireless Ad Hoc Networks—Bibliography lists http://w3.antd.nist.gov/wctg/manet/manet_bibliog.html (2005).

Wireless Communications for Smart Dust—Pister, K, et al http://robotics.eecs.berkeley.edu/~pister/publications/1998/smartdust_comm_memo.pdf#search=%22Wireless%20communications%20for%20Smart%20Dust%22 (2005).

What is Smart Dust anyway? http://www.wired.com/wired/archive/11.06/start_pr.html (2005).

Exlporing the Limits of System Integration with Smart Dust—Pister, K. et al http://www-bsac.eecs.berkeley.edu/archive/users/warneke-brett/pubs/imece2002-34360.pdf#search=%22Exploring%20the%%20Limits%20of%20System%20Integration%20with%20Smart%20dust%22 (2005).

Dust Networks http://www.dust-inc.com/products/main.shtml (2005).
Crossbow Technology Inc. htttp://www.xbow.com/Products/productsdetails.aspx?sid=3 (2005).
Smart Dust http://www.bsac.eecs.berkeley.edu/archive/users/warneke-brett/SmartDust/index.html (2005).
Smart Dust—Autonomous Sensing and Communication in a Cubic Millimeter http://robotics.eecs.berkeley.edu/~pister/SmartDust/ (2005).
Challenges in Location—Aware Computing http://www.cs.cmu.edu/~ jasojnh/courses/ubicomp-f2004/papers/05-loc.aware.computing.pdf#search=%22Challenges%20in%20Location-Aware%20Computing%22 (2005).
Nanotechnology Now—SmartDust & Ubiquitious Computing http://www.nanotech-now.com/smartdust.him (2005).
Smart Dust Advances in Russia http://www.gateway2russia.com/st/art_260273.php (2005).
Smart Dust and RFID Technology: Solutions for Business and Industry—John Suh http://wca.org/SIGS/RFID/RFID_SensorNetworks.pdf (2005).
Nanotechnology—(two articles: "Ultra-sensitive explosive dectectors" and "Smart Dust—a new porous-silicon-based nanotechnology") http://invent.ucsd.edu/news/newsletters_brochures/Nanotech2004.pdf (2005).
Smart Dust to Aid Military, Civilian Users http://www.dailycal.org/article.php?id=10951 (2005).
Visualizing the Upstream Future—Wood, Tony http://www-1.ibm.com/industries/cpe/download0/22030/chemical_visualizing.pdf or http://www.can.ibm.com/imc/petroweb/pdf/p13882visualizing.pdf (2.2—Intelligent Devices—Smart Dust) (2005).
National Defense Center for Environmental Excellence http://aec.army.mil/usaec/technology/uxo-407.pdf (2005).
Fractal Hash Sequence Representation and Transversal—Jakobsson, Markus http://www.informatics.indiana.edu/markus/papers/isit02.pdf (2005).
"Ionospheric signature of surface mine blasts from Global Positioning System measurements"—Calais, E; Minster, JB; Hofton, MA; Hedlin, MAH, Geophysical Journal International. 1998, v. 132, n. 1, p. 191, 12 p.
Scientists exploit the Global Positioning System—Palmer, Paul http://physicsweb.org/articles/world/10/9/5/1 (2005).

SECURITY ENHANCED BLASTING APPARATUS, AND METHOD OF BLASTING

CROSS REFERENCE TO RELATED APPLICATIONS

This application is a divisional application of U.S. application Ser. No. 11/354,929, filed Feb. 16, 2006, which claims benefit of U.S. Provisional Application No's. 60/653,085, filed Feb. 16, 2005, and 60/715,133, filed Sep. 9, 2005, the entire contents of each of which is incorporated herein by reference.

BACKGROUND OF THE INVENTION

The present invention relates to the field of blasting apparatuses for mining operations, as well as corresponding methods of blasting. In particular, the present invention relates to blasting apparatuses having an increased level of security.

BACKGROUND TO THE INVENTION

Mining operations often employ a blasting system or apparatus for controlling actuation of an array of explosive charges. Typically, explosive charges are positioned at the blast site, for example in drilled boreholes, and detonators are associated with the explosive charges. For example, during a blast event, signals may be transmitted to the detonators (often via shock tube, low energy detonating cord, electrical wires or wireless means) to cause initiation thereof, which in turn triggers actuation of each associated explosive charge. The efficiency and success of the blasting event may depend largely upon the careful positioning and timing of actuation of the explosive charges relative to one another, with the intention to provide near optimal shockwave interference, and rock fragmentation.

Safety is of paramount importance to blasting apparatuses, and those operating these systems. Over recent years, much research and development has focused upon providing improvements in safety, with the aim to minimize the risk of injury or death at the blast site. However, there remains significant room for improvements in safety in blasting apparatuses. In particular, many blasting apparatuses of the prior art include safety features designed to minimize the risk of inadvertent system setup, and improper or inadvertent detonator actuation by an experienced blast operator (see for example U.S. Pat. No. 6,644,202 issued Nov. 11, 2003). In contrast, perhaps less research and development can be attributed to the provision of blasting apparatuses that are functionally operable only in the hands of authorized users, thereby preventing or substantially preventing inadvertent detonator actuation (e.g. by children) or intentional, but malicious detonator actuation (e.g. by terrorists). Examples of a few such systems are discussed briefly below.

In one example, U.S. Pat. No. 5,520,114 issued May 28, 1996, discloses an apparatus and method for firing detonators involving a programming unit for programming a series of ignition modules with delay times. The firing console can simultaneously interrogate the ignition modules, which send back the requested information to program the firing console with the delay times. The firing console and the programming unit may be fitted with encoding means designed to limit their access to authorized users, and with means for internal mutual recognition before the transfer of delay times from the programming unit to the firing console. Further optional safety features require the operator to know recognition codes to access the firing and programming consoles. For example, the firing console can be fitted with a magnetic card for authorizing its use.

In another example, International Patent Application PCT/AU98/00929 published Nov. 6, 1998 discloses an electromagnetic induction detonation system involving an automated radio charge (ARCH) module connectable to an electric detonator and a transducer. The system further includes a remote controller for sending instructions to the transducer module from a remote location. Actuation of the detonator requires the transducer module to generate an electromagnetic field which is used to power the ARCH module and provide a detonation current. In one embodiment, the remote controller includes means for the manual entry of instructions by which a user must enter a valid identification number within a predetermined time period in order for the remote controller to establish a radio communication link with the transducer unit. In another embodiment, the remote controller unit includes a processor means for generating a unique identification code word which is continuously transmitted until an acknowledgment signal is received from the transducer unit corresponding to the identification code word. In the absence of receipt of the acknowledgment signal within a predetermined time period the remote controller adopts a 'reset' mode, thereby requiring a user to enter a new valid identification code before communication with the transducer unit is re-established.

In yet another example, U.S. Pat. No. 6,644,202 issued Nov. 11, 2003, discloses a method and apparatus for use in establishing a blasting arrangement by loading at least one detonator into each of a plurality of blast holes, placing explosive material in each blast hole, connecting to a trunk line a control unit that has a power source incapable of firing the detonators, sequentially connecting the detonators, by means of respective branch lines, to the trunk line and leaving each detonator connected to the trunk line. In addition the apparatus includes means for receiving and storing in memory means identity data from each detonator, as well as means such as a control unit for assigning a predetermined time delay to each detonator to be stored in the memory means. In this way, the detonators may be programmed to function only with the control unit and the control unit will function only with specific detonators, such that theft or other unauthorized acquisition of components of the blasting apparatus may be foiled.

The prior art discussed illustrates that improvements have been made in the development of blasting apparatuses that function only in the hands of authorized users, However, the consequences of blasting apparatuses, or components thereof, falling into the wrong hands can be severe, particularly if built-in countermeasures intended to prevent unauthorized usage can be foiled. For this reason, safety concerns remain paramount in the explosives industry, and there remains significant room for corresponding improvements in the safety of blasting apparatuses.

BRIEF SUMMARY OF THE INVENTION

It is an object of the present invention, at least in preferred embodiments, to provide a blasting apparatus that is substantially inoperable by unauthorized persons.

It is another object of the present invention, at least in preferred embodiments, to provide a method of actuating a series of explosive charges by way of a blasting apparatus that is operable only by authorized persons.

It is yet another object of the present invention, at least in preferred embodiments, to provide a blasting apparatus that 'recognizes' an authorized blast operator without the need to input authorization codes.

It is yet a further object of the present invention, at least in preferred embodiments, to provide improvements to the invention disclosed in International Patent Application PCT/GB00/01085, published as WO00/60305 on Oct. 12, 2000, which provides in part for a system for monitoring and logging the destruction of detonators during firing events.

In one aspect of the invention there is provided a blasting apparatus for use by a blast operator to control at least one detonator at a blast site, the blasting apparatus comprising:

at least one blasting machine for transmitting at least one command signal to said at least one detonator;

at least one biometric analyzer for recording information regarding at least one biometric feature of a candidate blast operator;

a blast authorizing means, for receiving and processing said information to generate a test biometric signature, and comparing said test biometric signature with known biometric signatures to attempt to determine whether said test biometric signature is derived from an authorized blast operator or an unauthorized blast operator;

said blasting apparatus maintaining or adopting an active state suitable for actuation of said at least one detonator if said test biometric signature and at least one known biometric signature from an authorized blast operator correspond;

said blasting apparatus maintaining or adopting an inactive state unsuitable for actuation of said at least one detonator if said test biometric signature and at least one known biometric signature derived from an unauthorized blast operator correspond or if said test biometric signature and none of said known biometric signatures correspond.

In another aspect of the invention there is provided a blasting apparatus for use by a blast operator to control at least one detonator at a blast site, the blasting apparatus comprising:

at least one blasting machine for generating or receiving at least one command signal, optionally processing, and transmitting said at least one command signal to said at least one detonator;

optionally a central command station for generating and transmitting at least one command signal to said at least one blasting machine;

a biometric analyzer associated with said central command station and each of said at least one blasting machine each for recording information regarding at least one biometric feature of a candidate blast operator;

a blast authorizing means associated with each biometric analyzer to receive and process said information to generate a biometric signature in each of said central command station (if present) and said at least one blasting machine; and comparison means to compare biometric signatures generated by at least two of said blast authorizing means, and to active said blasting apparatus upon identification of at least two biometric signatures derived from the same blast operator.

In another aspect of the invention there is provided a method of controlling a plurality of detonators at a blast site, the method comprising the steps of:

establishing a blasting apparatus of the invention at the blast site;

scanning at least one biometric feature of a candidate blast operator via said at least one biometric analyzer;

processing information derived from scanning said at least one biometric feature via said blast authorizing means, to generate a test biometric signature;

comparing said test biometric signature with known biometric signatures via said blast authorization means; and if said test biometric signature corresponds to a known biometric signature derived from an unauthorized blast operator, causing the blasting apparatus to adopt or maintain an active state suitable for actuation of said at least one detonator; and if said test biometric signature corresponds to a known biometric signature derived from an authorized blast operator, or if said test biometric signature does not correspond to a known biometric signature, causing the blasting apparatus to adopt or maintain an inactive state unsuitable for actuation of said at least one detonator.

In another aspect of the invention there is provided a method of controlling a plurality of detonators at a blast site, the method comprising the steps of:

establishing a blasting apparatus of the invention at the blast site;

scanning at least one biometric feature of a blast operator via each biometric analyzer associated with said central command station (if present) and said at least one blasting machine;

processing information derived from scanning said at least one biometric feature via each blast authorizing means, to generate at least two biometric signatures;

comparing said at least two biometric signatures to determine whether said biometric signatures are derived from the same blast operator, and if so; and causing the blasting apparatus to adopt or maintain an active state suitable for actuation of said at least one detonator.

In another aspect of the invention there is provided a method for modulating a functionality of a blasting apparatus, the method comprising the steps of:

generating a database of sample biometric signatures, each corresponding to an authorized blast operator or an unauthorized blast operator;

scanning a biometric feature of a candidate blast operator;

processing information derived from scanning to generate a test biometric signature;

comparing the test biometric signature to the sample biometric signatures in the database to determine whether the test biometric signature is derived from an authorized blast operator or an unauthorized blast operator; and if said test biometric signature is derived from an authorized blast operator, causing said blasting apparatus to adopt or maintain an active state suitable for actuation of said at least one detonator, or if said test biometric signature is derived from an unauthorized blast operator, causing said blasting apparatus to adopt or maintain an inactive state unsuitable or actuation of said at least one detonator.

In another aspect of the invention there is provided a method for generating a database for use in identifying a presence of an authorized blast operator, the method comprising the steps of:

scanning at least one biometric feature of at least one person including at least one authorized blast operator;

processing information for each biometric feature to generate corresponding biometric signatures each corresponding to an authorized blast operator or an unauthorized blast operator, and each forming an entry in the database.

Any of the methods of the present invention may involve the use of a smart card for storing information regarding a person's biometric signature and permitting transfer of this information to one or more components of the blasting system as required. In preferred embodiments, each smart card may further incorporate a biometric analyzer to allow scanning of a biometric feature in the field, prior to storage of information relating to the biometric feature.

DEFINITIONS

Figure 1:
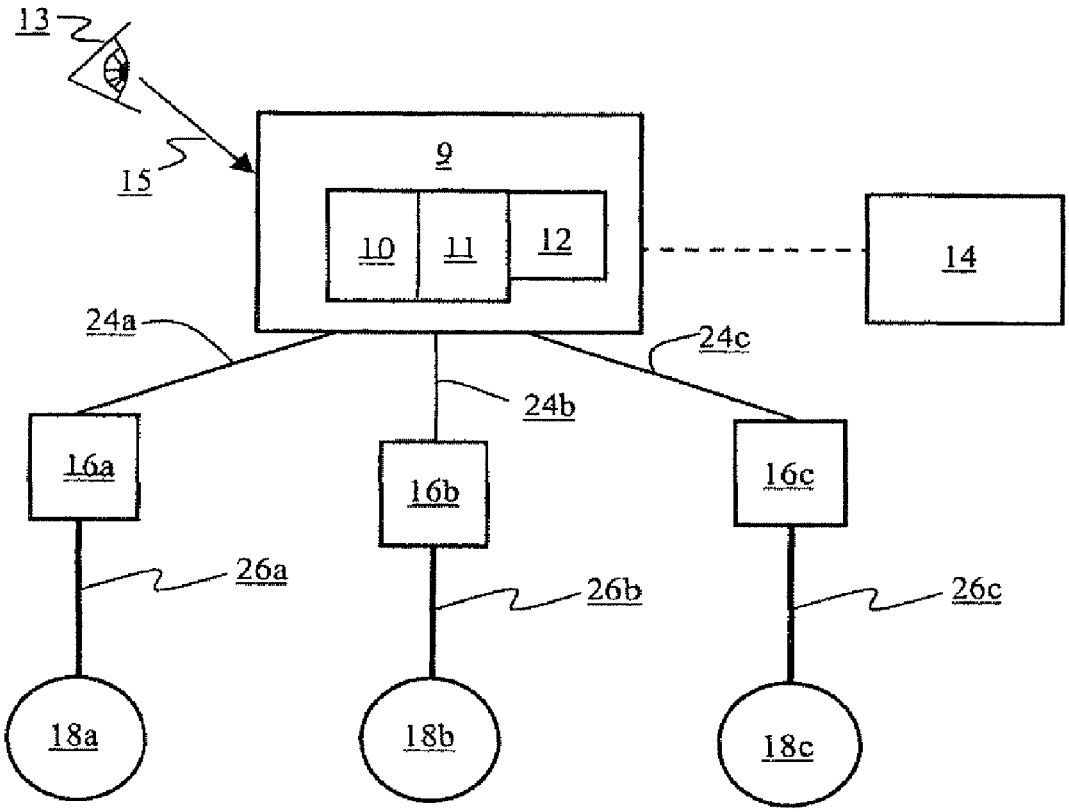
FIG. 1 illustrates a blasting apparatus of one embodiment of the present invention.

Biometric analyzer: Any device capable of scanning or otherwise analyzing one or more biometric feature of an individual (e.g. a blast operator). For example, in the case where the biometric analyzer scans a physical biometric feature the device may include a camera such as a digital camera or RF scanning means, and optionally means to store an image such as a digital image. Furthermore, a biometric analyzer may include storage means to store the image and means to communicate the image to a blast authorizing means. Examples of such a biometric analyzer unit include the Sony™ FIU-700 Biometric Unit, those produced under the trade name "V-pass" by the company Bioscrypt, as well as those described in U.S. Pat. No. 5,937,557, issued Aug. 17, 1999. However, biometric analyzers are not limited to those that capture and process images comprising biometric features. In this regard, the expression "biometric analyzer" includes devices that capture other biometric features including but not limited to voices (such analyzers may include a microphone and optionally sound recording means), DNA fingerprints (such analyzers may include DNA sampling, extraction and analysis means), written signatures (such analyzers may include computer-based signatures analysis). Other biometric analyzers may involve the use of skin spectroscopy for example to measure surface or subcutaneous spectral properties of the skin. Other biometric analyzers may detect vein patterns and include means for example to analyze finger vein patterns by the presence of haemoglobin in subcutaneous veins. Such finger vein pattern analyzers may be obtained from manufacturers such as Hitachi.

Biometric feature: any feature that is unique or substantially unique between two or more persons. Preferably, a biometric feature is readily accessible and suitable for analysis or scanning via a biometric analyzer. Biometric features may be selected from the following non-limiting group: a fingerprint, an iris, a retina, a face, a hand, a DNA fingerprint etc. In other embodiments the biometric feature may include an entire face. Other biometric features include skin spectroscopy (including surface or deep skin spectroscopy), vein patterns such as finger vein patterns (for example assessed by measuring haemoglobin presence in subcutaneous veins). The expression 'biometric feature' is not limited to material features, and may include for example, a voice or spoken word that can be recorded by a biometric analyzer for subsequent analysis, or a signature recognition for a written signature.

Biometric key: Any portable device comprising storage media for a biometric signature or other information relating to one or more biometric features of an individual. For example, a biometric key may take the form of a card-type device that optionally may comprise a biometric analyzer and means to store information corresponding to one or more biometric features. A biometric key may be transferred between various components of a blasting system to transfer information relating to biometric features between the components.

Biometric signature: a biometric signature is an electronically generated code or data packet representative of an individual (e.g. a blast operator) and unique or substantially unique to that individual. Typically, a biometric signature is generated by receiving and processing information regarding one or more of an individual's biometric features, for example by one or more biometric analyzers. Further, in preferred embodiments a biometric signature may further include additional data such as for example a password, code, geographical coordinates or the handwritten signature of the individual. Optionally, the biometric signature may be encrypted, for example by 32 bit encryption means, thereby to foil attempted retrieval and use of biometric signatures by unauthorized persons.

Blast authorizing means: includes any device capable of receiving information with regard to one or more biometric features from one or more biometric analyzers, and processing this information to generate a biometric signature to determine if the biometric signature is derived from an authorized blast operator. In preferred embodiments, a blast authorizing means may further include a memory means having a database or the like for storing biometric signatures, including new biometric signatures from candidate blast operators, and previously stored biometric signatures from known/authorized/unauthorized blast operators. In further preferred embodiments a blast authorizing means may further comprise a comparator means (as described below), for comparing biometric signatures of candidate blast operators with biometric signatures of known/authorized/unauthorized blast operators to determine whether a candidate blast operator is authorized to control the blasting apparatus and initiate a blast event. In addition, a blast authorizing means may include communication means for communicating information via electrical wires or wireless means to other components of a blasting system, such as for example to activate the blasting apparatus in response to the identification of a biometric signature from an authorized blast operator, or to deactivate the blasting apparatus in response to the identification of a biometric signature from an unauthorized blast operator. Alternatively, the blast authorizing means may be located off site or communicate via wired or wireless means with off-site components.

Blast operator: For the purposes of this specification, a blast operator encompasses anyone who uses or attempts to use a blasting apparatus of the present invention. The expression 'blast operator' includes a 'candidate blast operator' who is a blast operator attempting to gain access to and control of a blasting apparatus of the invention by allowing analysis by components of the blasting apparatus of his/her biometric features. The expression 'authorized blast operator' refers to a candidate blast operator who has been determined by components of the blasting apparatus to be authorized to operate the blasting apparatus by reason of competency and/or sufficient training and/or trustworthiness. In contrast, the expression 'unauthorized blast operator' refers to those blast operators who fail to meet the requirements of an authorized blast operator.

Blasting apparatus: For the purposes of this specification, a blasting apparatus may include one or more blasting machines and associated detonators or detonator assemblies. The blasting apparatus may further include additional components such as one ore more additional blasting machines, and optionally a central command station. The detonators and other components of a blasting apparatus may communicate via physical means such as electrical wires, low energy detonating cord, or shock tube, or alternatively may communicate via wireless means such as radio waves, electromagnetic induction or light (e.g. laser light) signaling means. The expressions 'blasting system' and 'blasting apparatus' are essentially synonymous on the understanding that they may include various physically joined or separate components working on conjunction with one another to control and optionally actuate detonators.

Blasting machine: a device in signal communication with one or more detonators, for arming, disarming, and firing thereof via the receipt and/or relay of signals transmitted from a central command station. A typical blasting machine may be in communication with one or more detonators or groups of detonators via wireless means such as radio-communication or direct physical connection (e.g. low energy detonating cord, shock tube, or electrical connection). The term blasting machine also encompasses a device that itself generates command signals, or detonator firing codes, typically in blasting apparatuses that do not employ a central command station. A blasting machine may also be capable of receiving and processing information from detonators associated therewith, including firing codes, delay times, and information regarding the position and conditions of detonators. Blasting machines may themselves be assigned a unique identification to differentiate each blasting machine from every other blasting machine in the blasting apparatus or system. Typically, an identification code may be semi-permanently assigned to a blasting machine for a predetermined time period, or for the lifetime of the blasting machine.

Central command station: any device that transmits signals via radio-transmission or by direct connection, to one or more blasting machines. The transmitted signals may be encoded, or encrypted. Typically, the central blasting station permits radio communication with multiple blasting machines from a location remote from the blast site. In more preferred embodiments, a blasting machine is an i-kon blasting machine, most preferably an i-kon Blaster 400 or and i-kon Blaster 1600S.

Communication means: Any means transmitting information, such as electrically stored data, from one source to at least one other. Transmission may be through wireless communication (e.g. radio waves, electromagnetic induction, light signaling etc.), wired communication (e.g. electrical wires, low energy detonating cord, shock tube etc.)

Corresponds: in specific embodiments, a test biometric signature is described to correspond to a known biometric signature of an authorized or unauthorized blast operator. For the sake of clarity, the terms "corresponding" or "corresponds" provide that a test biometric signature exhibits identical or similar features to a known biometric signature sufficient to deduce that the test biometric signature is likely derived from the same biometric feature of the same blast operator. In this way, a determination can be made as to whether a test biometric signature is derived from an authorized or an unauthorized blast operator. It should be noted that to achieve correspondence, two biometric signatures need not be identical, but at least achieve a degree of similarity greater than a predetermined threshold.

Detonator: this term pertains to any form of electronic or electric detonator. Such forms are well known in the art and typically comprise a shell, a base charge, and means to actuate the base charge in response to some form of electronic or wireless signal. In preferred embodiments, 'detonator' relates to those detonators that include programmable initiation means, for example that include means to store unique detonator identification information, and/or detonator firing codes. Furthermore, in preferred embodiments, the detonators and their associated blasting machines may be defined as being "secure", such that "secure" detonators will only be capable of actuation when in association with a corresponding "secure" blasting machine, and likewise a "secure" blasting machine will only be operational when connected to correspondingly "secure" detonators. Dialog between "secure" detonators and corresponding "secure" blasting machines can only occur if the detonators are predesignated to function with a selected "secure" blasting machine. The term detonator further includes detonator assemblies comprising other components required for the control and actuation of the base charge of the detonator. For example, in the case of a wireless detonator assembly the components may include wireless signal receiving and processing means.

Detonator firing code—each detonator firing code may include in electronic form identification information and/or delay time information for each individual detonator or group of detonators.

DNA fingerprint recognition scan: any form of analysis that can identify a DNA fingerprint of an individual in such a manner that the DNA fingerprint is substantially distinguishable from a DNA fingerprint of most if not all other individuals. DNA fingerprint analysis is well known to persons of skill in the art of molecular biology are described for example in Sambrook, J. et at (1989) in: Molecular Cloning: A Laboratory Manual ($2^{nd}$ ed.), Cold Spring Harbor Laboratory Press, New York, and may involve, for example, techniques including restriction endonuclease digestion, polymerase chain reaction, agarose or polyarylamide gel electrophoresis, autoradiography, and analysis of polymorphisms such as restriction fragment length polymorphisms and single nucleotide polymorphisms.

Face recognition scan: pertains to any form of analysis of a face of an individual (e.g. a blast operator) sufficient to highlight and permit subsequent analysis of the identifying characteristics of the face specific to the individual, and different to most if not all other individuals. The scan may involve the use of a camera such as a digital camera to generate an image such as a digital image of sufficient quality for subsequent image processing to determine the distinguishing characteristics of each face.

Fingerprint recognition scan: pertains to any form of analysis of one or more fingerprints of an individual (e.g. a blast operator) sufficient to highlight and permit subsequent analysis of the identifying characteristics of each fingerprint specific to the individual, and different to most if not all other individuals. The finger may be moved over or placed onto an appropriate sensor or scanner surface. The scan may involve the use of a camera such as a digital camera or surface mapping device to generate and image such as a digital image of sufficient quality for subsequent image processing to determine the distinguishing characteristics of each fingerprint. For example, the surface mapping may involve use of the use of radio signals to scan the electrical properties of a surface layer of living skin. In preferred embodiments, the fingerprint recognition scan may involve the use of a BioScrypt V-Pass scanner preferably in combination with scanning analysis and processing software such as the Veri-Series enrollment software. In other preferred embodiments, the image may be processed using an associated software package to smooth fingerprint patterns and/or correct anomalies or defects in a fingerprint generated for example by the presence of dirt or scars.

Hand or foot recognition scan: pertains to any form of analysis of one or more hands or feet of an individual (e.g. a blast operator) sufficient to highlight and permit subsequent analysis of the identifying characteristics of each hand or foot specific to the individual, and different to most if not all other individuals. The scan may involve the use of a camera such as a digital camera to generate an image such as a digital image of sufficient quality for subsequent image processing to determine the distinguishing characteristics of each iris.

Iris recognition scan: pertains to any form of analysis of one or more irises of an individual (e.g. a blast operator) sufficient to highlight and permit subsequent analysis of the identifying characteristics of each iris specific to the individual, and different to most if not all other individuals. The scan may involve the use of a camera such as a digital camera to generate an image such as a digital image of sufficient quality for subsequent image processing to determine the distinguishing characteristics of each iris.

Portable device: pertains to any device that is easily transported between components of the blasting apparatus of the present invention, and which further comprises means for electronically storing information such as information that relates to the identity of a blast operator, and in particular a biometric signature of a blast operator. In this way, the portable device may form part of the personal property of the blast operator for presentation at each blasting event, for example to input a biometric signature into one or more components of a blasting apparatus of the present invention with the intention to active the apparatus for a blasting event in accordance with the teachings of the present invention. The portable device may have the biometric signature information inputted onto the device by inserting the device into a suitable writer for writing the biometric signature information thereto. Alternatively, the portable device may have incorporated therein a biometric analyzer and other means to analyze, process, and record information relating to one or more biometric features directly onto the device. Preferably, the portable device is secure, in that the information stored electronically on the portable device can only be read by an appropriate reader device specifically designed to 'read' the electronic information from the portable device in a secure manner. In this way, illicit attempts to retrieve information from the portable device will be essentially foiled. In most preferred embodiments, the device may take the form of a card-like device such as a smart card.

Smart card: A smart card is a preferred type of portable device. For example, a smart card may take the physical form of a credit card-like device that includes any form of electronic storage media suitable for storing biometric signature information, and information relating to the blast operator and owner of the smart card. Preferably, the smart card is "secure", in that the information stored electronically on the portable device can only be read by an appropriate reader device specifically designed to 'read' the electronic information from the portable device in a secure manner. In this way, illicit attempts to retrieve information from the smart card will essentially be foiled.

Preferably: unless otherwise indicated the term "preferably" generally precedes disclosure of one or more preferred features of the broadest embodiments of the invention. Any preferred feature may be optional to all embodiments of the invention, and limits only the broadest embodiments of the invention unless otherwise indicated.

Retina recognition scan: pertains to any form of analysis of one or more retina of an individual (e.g. a blast operator) sufficient to highlight and permit subsequent analysis of the identifying characteristics of each iris specific to the individual, and different to most if not all other individuals. The scan may involve the use of a camera such as a digital camera to generate an image such as a digital image of sufficient quality for subsequent image processing to determine the distinguishing characteristics of each retina.

Voice recognition analysis: involves any method, and devices required for analyzing a voice of one or more individuals. For example, such analysis may include the use of a microphone to record the voice, as well as sound recording means to record the sound of the voice and convert the sound into a suitable electronic form for subsequent processing and analysis, for example to compare the characteristic features of the voice to characteristic features of known voices. In preferred embodiments the voice recognition may also involve password recognition for a password spoken by a voice.

DESCRIPTION OF THE PREFERRED EMBODIMENTS

The inventors have succeeded in the development of a blasting apparatus having significant improvements in security. The inventors believe that the present invention represents the first time that biometric analysis has been contemplated and successfully incorporated as an integral feature of a blasting apparatus for use in mining operations, wherein the blasting apparatus comprises multiple components in communication with one another. In selected embodiments, specific components of the blasting apparatus of the present invention employ biometric analysis to determine whether a blast operator is authorized to control and/or initiate a blast, and if so, to bring the blasting apparatus into an active state whereby detonators may be controlled and actuated as desired by the authorized blast operator. Authorized blast operators include those persons who are properly trained, competent, or trustworthy to establish and/or control the blasting system, and initiate a blasting event at a desired time. In this way, unauthorized blast operators such as, for example, children, operators with insufficient skill, training or experience to operate the blasting system, or terrorists, will be substantially unable to active the blasting apparatus into a functional state for blasting.

The blasting apparatuses of the present invention in preferred embodiments comprise security features that work in conjunction with biometric analysis systems. It should be noted, however, that the blasting apparatuses of the present invention encompass any blasting apparatus designed to initiate one or more detonators at a blast site that includes some form of biometric analysis to determine whether the blast operator is authorized to control the blast system. If the presence of an authorized blast operator is not detected via biometric analysis then the blasting apparatus will remain in some form of inactive "safe" state, or alternatively may undergo some form of predetermined shut down or deactivation process. In preferred embodiments, the detection of an unauthorized blast operator may result in the blasting apparatus maintaining an inactive "safe" state, a shut down or deactivated state for an indefinite period, or for a limited amount of time. It should also be noted that any form of biometric analysis may be used for the purposes of determining whether a candidate blast operator is an authorized blast operator. Such forms of biometric analysis include, but are not limited to, a fingerprint recognition scan, a hand recognition scan, a foot recognition scan, an iris recognition scan, a face recognition scan, a retina recognition scan, a voice recognition analysis, a DNA fingerprint analysis or a written signature recognition.

In selected embodiments, the apparatus of the present invention may be used in conjunction with a system equivalent to that described by International patent publication WO00/60305, which is incorporated by reference. This system allows for the logging of authorized detonator usage of identifiable detonators, for example, after removal of the detonators from a controlled store. As such, a firing control station monitors and logs the destruction of each detonator after transmission thereto of a FIRE signal. The inventors contemplate the combination of the apparatus of the present invention with a system the same or similar to that described by WO00/60305. In this way, the time of the detonator firing, the nature of the material being actuated, and the person responsible for the blasting event, can be centrally monitored, and the information stored accordingly for future reference. Further selected embodiments of the invention relate to the incorporation of GPS tracking devices into specific components of the apparatus of the present invention. In this way, and in conjunction with the features outlined in WO00/60305, the inventors contemplate the provision of a blasting apparatus that will allow determination, monitoring and recordal of the following information for the firing of each identifiable detonator: what was fired, when, where, and by whom. All such information may be transmitted via any means (including wireless means) to a centralized monitoring facility and database.

Additional aspects and embodiments of the present invention will become apparent from the specification in its entirety.

The inventors have developed blasting apparatuses that provide significant improvements in operational security for blasting events, when compared to blasting apparatuses of the prior art. In this regard the inventors have succeeded in developing blasting apparatuses that incorporate biometric analysis to determine whether a blast operator is authorized to use the blasting system. Preferred aspects of the invention pertain to the incorporation of biometric analyzers into one or more key components of a blasting apparatus, as well as dialog between the biometric analyzers, associated components, and other devices in the blasting system.

The blasting apparatuses of the present invention encompass newly developed blasting apparatuses that incorporate biometric analysis, as well as those of the prior art adapted to incorporate the additional components for biometric analysis, as described herein.

Previously, biometric analysis and corresponding components have primarily been incorporated into individual weapons, tools, and heavy machinery (see for example U.S. Pat. No. 5,937,557, issued Aug. 17, 1999, international patent application WO03/098537 published Nov. 27, 2003, and U.S. patent application 2002/0088620 published Jul. 11, 2002, all of which are incorporated herein by reference).

The applicants believe that the present invention represents the first time that biometric analysis has been contemplated and successfully incorporated into complex blasting apparatuses involving a plurality of detonators and control devices suitable for large scale blasting events that are typical of mining operations. Through careful experimentation, the inventors have determined that blasting apparatuses comprising biometric authorization means in accordance with the present invention are virtually unusable in the hands of unauthorized persons. In this way the invention presents a substantially insurmountable barrier to those seeking to break the security features of a blasting system. The analysis of at least one biometric feature allows for the generation of a biometric signature (a test biometric signature) preferably of sufficient complexity that may be compared to other biometric signatures to determine whether a test biometric signature is derived from an authorized person. The complexity of the biometric signature may be increased with the number of biometric features under analysis. Furthermore, in a preferred embodiment of the invention, each biometric signature (whether newly generated or stored for comparative purposes) may be encrypted for example by 32 bit or any other form of secure encryption, to substantially prevent retrieval and use of stored or transmitted biometric signatures for illicit purposes. Persons of skill in the art will appreciate from the above, and the embodiments subsequently described, the significant contribution of the present invention to this technical field.

The blasting apparatus of the present invention can be used with any suitable detonators, and may incorporate any blasting machines, central command stations and other components that are known in the art for blasting operations. A particularly preferred embodiment of the invention relates to the use of the blasting apparatuses described in U.S. Pat. No. 6,644,202 issued Nov. 11, 2003 in conjunction with the biometric security features described herein. In specific embodiments, the blasting apparatus disclosed in U.S. Pat. No. 6,644,202 includes means for receiving and storing in memory means identity data from each detonator, as well as means such as a control unit for assigning a predetermined time delay to each detonator to be stored in the memory means. In this way, the detonators may be programmed to function only with the control unit and the control unit will function only with specific detonators, such that theft or other unauthorized acquisition of components of the blasting apparatus may be foiled. Without wishing to be bound by theory, the inventors consider that the biometric features of the blasting apparatuses of the present invention may integrate well and provide unprecedented levels of security when combined with the blasting apparatuses of U.S. Pat. No. 6,644,202.

The present invention, at least in preferred embodiments, provides a blasting apparatus and a corresponding method of blasting that provides dramatic improvements in the security of blasting apparatuses and virtually eliminates the possibility of accidental or illicit use of the blasting apparatus by unauthorized users. In this way, detonator control and actuation is substantially limited to authorized users. As will become more apparent from the following examples, one feature of the blasting apparatus of the present invention involves the use of one or more biometric analyzers to confirm whether an individual under analysis (a candidate blast operator) is authorized to control the blasting apparatus and carry out a blasting event. Following electronic processing of various information regarding the biometric features of the individual, a decision made by components of the blasting apparatus regarding whether the individual exhibits the biometric characteristics and features of known, authorized blast operators. If a positive decision is made, in that an authorized blast operator is identified, then the appropriate signals are transferred between components to activate the blasting apparatus for control and possible actuation of associated detonators. On the other hand, if a negative decision is made, for example if an authorized blast operator is not identified or if an unauthorized blast operator is identified, then the appropriate signals then the blasting apparatus either remains in an inactive, "safe" mode, or appropriate signals are transferred between components to specifically deactivate the blasting system.

In one form, a blasting apparatus of the present invention may comprise:

at least one blasting machine for transmitting at least one command signal to said at least one detonator;

at least one biometric analyzer for recording at least one biometric feature of a candidate blast operator;

a blast authorizing means, for receiving and processing said information to generate a test biometric signature, and comparing the test biometric signature with known biometric signatures, said blasting apparatus adopting or maintaining an active state suitable for actuation of said at least one detonator if said test biometric signature corresponds to a known biometric signature derived from an authorized blast operator, said blasting apparatus adopting or maintaining an inactive state unsuitable for actuation of said at least one detonator if said test biometric signature corresponds to a known biometric signature derived from an unauthorized blast operator. Optionally, each blasting machine may be in signal communication with a central command station, which may optionally be positioned remote from the blast site.

One exemplary embodiment of the present invention will now be described with reference to FIG. 1. A blasting apparatus is shown, comprising a central command station 9, in signal communication 24*a*, 24*b*, 24*c* with a series of blasting machines 16*a*, 16*b*, and 16*c*. In turn, each blasting machine 16*a*, 16*b*, 16*c* is in signal communication with at least one detonator 18*a*, 18*b*, 18*c* via signal transmission lines 26*a*, 26*b*, 26*c* respectively. For simplicity, only a single detonator is shown in association with each blasting machine. It will be appreciated that any method of communication between the central command station and each blasting machine may be used, including both wired, and wireless means. Typically, a central command station 9 will communicate 24*a*, 24*b*, 24*c* with each blasting machine 16*a*, 16*b*, 16*c* via radio communication means, such that the central command station is positioned at a location remote from the blast site and out of harm's way. Each blasting machine may be in signal communication with each detonator via any means including wired and wireless means. For example, in the embodiment illustrated in FIG. 1, each detonator is associated with each blasting machine via electrical wires 26*a*, 26*b*, 26*e*.

In the embodiment illustrated in FIG. 1, a biometric analyzer unit 10, and a blast authorizing means 11 form an integral part of the central command station 9 located remote from the blast site. In use, a candidate blast operator who wishes to use the blasting apparatus presents himself/herself to a suitable authority, for example in a blast office, remote from the blast site, where the central command station 9 is located. The candidate blast operator has a biometric feature 13 scanned 15 by the biometric analyzer 10, and information relating to the biometric feature is processed by the blast authorizing means 11.

The embodiment illustrated in FIG. 1 includes a database comprising known biometric signatures of known authorized blast operators. In this way, the blast authorizing means may process the biometric signature generated for the candidate blast operator and compare this biometric signature with previously stored biometric signatures of known blast operators to determine whether the candidate blast operator is authorized or unauthorized to control the blast system. It will be appreciated that the database can form another integral part 12 of the central command station. However, it will also be appreciated that in alternative embodiments the blast authorizing means and/or the database may be in another secure position 14 away from the blast site and/or the central command station. For example, the step of determining whether a candidate blast operator is authorized to control the blast system may be carried out in the head office of the detonator/blasting apparatus supplier. In this way, the head office may monitor all attempted blasting events, and persons using the blasting apparatuses of the present invention. Moreover, the communications link with the head office may be two-way, such that the head office may override any decision of the blast authorizing means for example to allow a blasting event to occur even in the absence of an authorized blast operator, or to prevent a blasting event from occurring even in the presence of an authorized blast operator. For example, in some preferred embodiments such monitoring may occur over the internet. In this way, the head office may remotely log all blasting events, including information relating to the person conducting the blast, the time of the blast, and (in the event that the blasting apparatus includes some form of positioning device such as GPS) the location of the blasting event. For the sake of clarity, it should be noted that signals derived from the blast authorizing means, with the intention of activating or deactivating the blasting system, may be directed in any manner and to any other component(s) of the blasting apparatus or elsewhere, providing that they achieve their end goal of activating or deactivating the blasting apparatus in some way. Such signals may also be directed through a monitoring system either at the blast site or at a position remote from the blast site to monitor and optionally record all activities with regard to the use of the blasting system, and those attempting to use it.

In any event, once the biometric signature has been generated by the blast authorizing means, and a decision made regarding whether the candidate blast operator is authorized, a signal may be sent by the blast authorizing means to any component of the blasting apparatus to active or deactivate the system. If the candidate blast operator is authorized then a signal may be transmitted via any appropriate means to the central command station and/or each of the blasting machines and/or each of the detonators to active the blasting apparatus in some way for control by the blast operator and possible actuation of the detonators. For example, the blast authorizing means may cause a signal to be sent by the blast authorizing means to the central command station, to switch the central command station into a mode suitable for subsequent transmittal of command signals to the detonators via the blasting machines.

In another embodiment of the invention similar to that discussed in relation to FIG. 1, each blasting machine may be separately equipped with an associated biometrics analyzer and a blast authorizing means for separate analysis of one or more biometric features of the candidate blast operator. In this embodiment, a central command station, if present, may optionally further include another biometric analyzer and blast authorization means to conduct another check of the biometric signature of the blast operator. In this way, each blasting machine and the central command station (if present) may be separately activated to become part of the blasting system, providing that the candidate blast operator is an authorized blast operator, and that he/she presents himself/herself to each blasting machine and the central command station in the blasting apparatus during setup. One advantage of integrating or attaching a biometric analyzer unit to each blasting machine is that each blasting machine will remain inactive, or be deactivated, following theft or unauthorized acquisition thereof (with or without associated detonators), even if the unauthorized blast operator attempts to activate the blasting machine by inputting his/her biometric features into the blasting machine.

Other embodiments of the invention will now be discussed with reference to FIGS. 2*a* and 2*b*. This embodiment includes a central command station 31, in signal communication 32 with a series of blasting machines 33*a*, 33*b*, 33*c*. Each blasting machine 33*a*, 33*b*, 33*c* in signal communication 34*a*, 34*b*, 34*c* via wired or wireless means) with one or more detonators 35*a*, 35*b*, 35*c* in a similar manner to the embodiment illustrated in FIG. 1. However, in contrast to FIG. 1, each blasting machine and the central command station have associated therewith, or forming an integral part thereof, a biometric analyzer 36*a*, 36*b*, 36*c*, 36*d* and a blast authorizing means 37*a*, 37*b*, 37*c*, 37*d*.

Figure 2A:
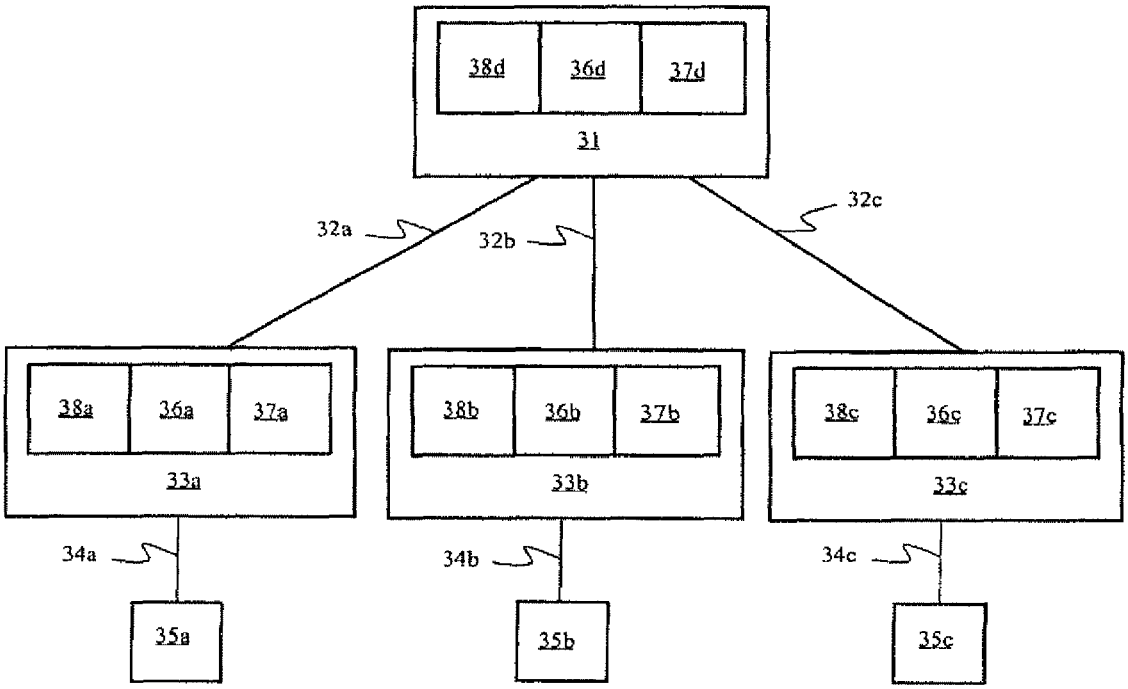
FIG. 2*a* illustrates a blasting apparatus of one embodiment of the present invention.

With reference to FIG. 2*a*, this embodiment encompasses a blasting apparatus where each blasting machine and the central command station are separately activatable, and each blast authorizing means further comprises a database 38*a*, 38*b*, 38*c*, 38*d* of biometric signatures for authorized and/or unauthorized blast operators. A candidate blast operator establishes each blasting machine (and corresponding detonators) and the central command station, and in doing so inputs his/her biometric data via each corresponding biometric analyzer 36*a*, 36*b*, 36*c*, 36*d* for processing via each corresponding blast authorizing means 37*a*, 37*b*, 37*c*, 37*d*. Each processing event of each blast authorizing means includes a comparison of the candidate blast operator's biometric signature with the biometric signatures stored in each corresponding database 38*a*, 38*b*, 38*c*, 38*d*, and if the candidate blast operator is identified as an authorized blast operator then each blasting machine or central command station in question is activated to form part of the blasting system. Therefore, this embodiment requires cross-talk via wired or wireless communication between components of the blasting apparatus for biometric signature comparison.

Figure 2B:
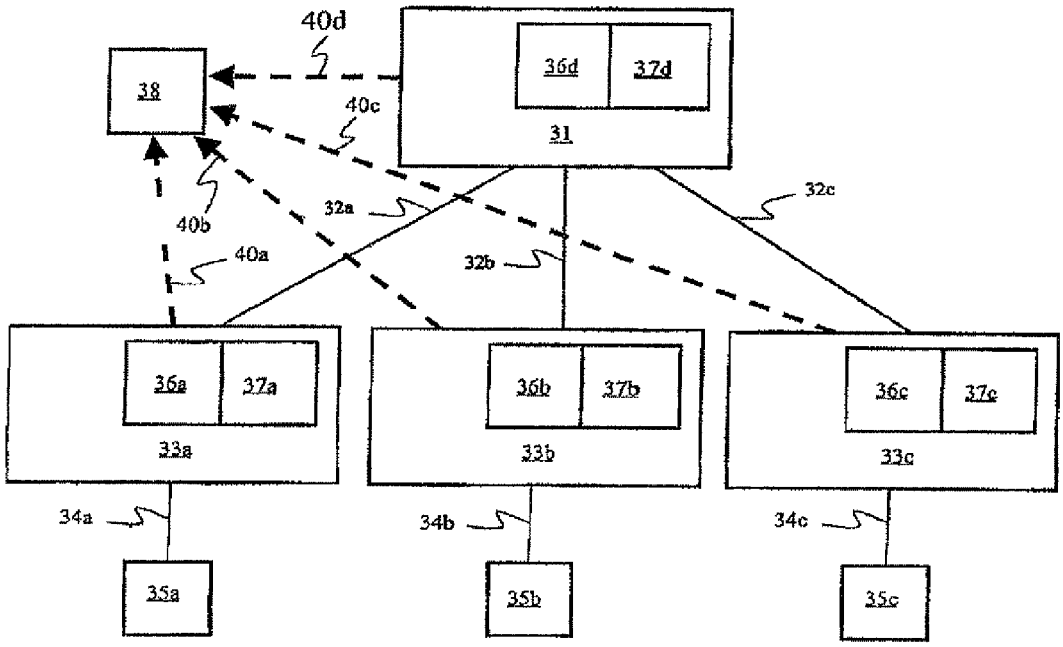
FIG. 2*b* illustrates a blasting apparatus of one embodiment of the present invention.

A similar but contrasting embodiment of the invention is illustrated in FIG. 2*b*. Unlike the embodiment illustrated in FIG. 2*a*, none of the blasting machines 33*a*, 33*b*, 33*c* nor the central command station 31 have associated therewith a database comprising biometric signatures. In use, the blast operator establishes the blasting machines (and associated detonators), and inputs his/her biometric data into each blasting machine in a similar manner to that described with reference to FIG. 2*a*. However, each blast authorizing means merely generates a biometric signature and transmits information (40*a*, 40*b*, 40*c*, 40*d*) regarding each biometric signature to a central database 38 optionally associated with the central command station 31. The blast operator, upon relocating to the central command station, inputs his/her biometric data into the central command station in the usual manner. Subsequently, the biometric signatures received from each blasting machine and the central command station are compared. If two or more of the biometric signatures from different components of the blasting apparatus correspond then the blasting apparatus may be activated for control by the blast operator. In this way, the use of biometric data analysis in this instance verifies that the blast operator establishing the blasting machines (and associated detonators) at the blast site and the blast operator attempting to control the blasting apparatus via the central command station are one and the same person.

Upon review of the embodiment illustrated in FIG. 2*b*, it will be appreciated that database 38 may reside in any blasting machine or the central command station. In this way, a biometric signature can be transmitted by the central command station for receipt by the blasting machines (or vice versa). For example, each blasting machine can compare biometric signatures received directly from an associated biometric analyzer and blast authorizing means, and a biometric signature transmitted by and received from the central command station. Upon receipt of corresponding biometric signatures derived from the same blast operator, the blasting apparatus become suitably active for control by the blast operator. In further embodiments, dialog relating to biometric signature comparison may occur between blasting machines, or indeed between any components of the blasting system. The embodiments described with initial reference to FIG. 2*b* may or may not involve a comparison of the blast operator's biometric signature with known biometric signatures. Nonetheless it will be appreciated that the security of the blasting apparatus would be further enhanced by ensuring that the blast operator attempting to use the blasting apparatus is the same blasting operator that established the blasting apparatus and physically set up or attended each of the principle components of the blasting apparatus prior to the blast event.

It will also be appreciated that the embodiments described with reference to FIGS. 2*a* and 2*b* may be combined. In other words, the present invention may encompass embodiments in which each blasting machine and the central command station each comprise biometric analyzers and blast authorization means, each blasting machine and the central command station being separately activated only upon detection of a biometric signature derived from an authorized blast operator (according to comparison with known biometric signatures in a corresponding database), and in addition the components of the blasting apparatus may communicate with one another (e.g. blasting machines with central command station or vice versa) to cross-check that the same biometric signature is input at different location in the blasting system, as discussed above.

It will further be appreciated that the embodiments shown in FIGS. 2*a* and 2*b* would be useful in the presence of absence of a central command station. For example, each blasting machine may comprise a biometric scanner and a blast authorizing means for generating a biometric signature, whereby the biometric signatures generated in two or more blasting machines of the blasting apparatus are compared. If the biometric signatures of the two or more blasting machines correspond, then the blasting apparatus may be caused to adopt or maintain an active state suitable for actuation of one or more associated detonators.

In another variant of any of the embodiments of the invention, upon confirmation that a candidate blast operator is an authorized blast operator, the blasting machines may be activated to function with the detonators only for a limited period of time sufficient to execute a blasting event. By activating the system for a limited period of time, the possibility of unauthorized users taking control of the blasting apparatus and executing an unauthorized blast is greatly diminished.

Each component of the blasting apparatuses of the present invention may optionally be "tagged" using a GPS tracking device. In a particularly preferred embodiment, each biometric analyzer associated with the blasting apparatuses may be tagged with a GPS tracking device so that every time a biometric feature is scanned for the purpose of gaining access and control of the blasting system, the time and/or geographical location of the scanning event, and the identity of the person being scanned, is recorded. This information may be logged or recorded in a memory either located at the blasting site, or where off-site communications are available, to a memory located remote from the blast site, for example in the office of a mining company. Moreover, in selected embodiments, the apparatus of the present invention may be used in conjunction with a system with features similar or equivalent to that described by International patent publication WO00/60305, which is incorporated by reference. This system allows for the logging of authorized detonator usage of identifiable detonators, after removal of the detonators from a controlled store. As such, a firing control station monitors and logs the destruction of each detonator after transmission thereto of a FIRE signal. The invention encompasses the combination of the apparatus of the present invention with a system the same or similar to that described by WO00/60305. In this way, the time of the detonator firing, the nature of the material being actuated, and the person responsible for the blasting event, can be centrally monitored, and the information stored accordingly for future reference.

As discussed, selected embodiments of the invention include the incorporation of GPS tracking devices into specific components of the apparatus of the present invention. In this way, and in conjunction with the features outlined in WO00/60305, the inventors contemplate the provision of a blasting apparatus that will allow, determination, monitoring and recordal of the following information for the firing of each identifiable detonator: what was fired, when, where, and by whom. All such information may be transmitted via any means (including wireless means) to a centralized monitoring facility and database, such that all detonator firing can be carefully tracked and recorded, preferably in real time.

This type of data may optionally be monitored by appropriate authorities or an automated monitoring station such as a police station or counter terrorist unit, to watch for possible illicit use of the blasting apparatus by unauthorized persons. Moreover, when such illicit use is detected, the relevant authorities may be informed to intercept those unauthorized persons attempting to gain access to the blasting apparatus or components thereof. For example, this type of monitoring may help to identify unauthorized persons and/or the position of such persons specifically prohibited from using the blasting apparatuses of the invention, thereby to allow those persons to be tracked and intercepted.

In addition, the use of a blasting system, even by an authorized user, may be considered inappropriate by those persons monitoring a blasting event at any given time, such that activation of the blasting apparatus may be overridden. For example, this would be useful in a scenario where an authorized blast operator had been kidnapped, and was being forced to input biometric data in order to activate a blasting apparatus for illicit use. In this scenario, the present invention includes the use of a database comprising known biometric signatures, wherein the known biometric signatures include duress biometric signatures. For example, if an authorized blast operator is forced to input his/her fingerprint biometric signature under conditions of duress, he/she may have previously assigned an index finger fingerprint for normal use to achieve access to the blasting system, and a middle finger fingerprint as a duress fingerprint for use under conditions of duress. Therefore, if the blast operator is forced to input a biometric signature under duress, he/she may choose to input a biometric signature from the middle finger. Persons monitoring the blasting event, for example from a remote location, may then be alerted to the fact that the blast operator is acting under duress, and alert the appropriate authorities. If the blasting apparatus further includes some form of GPS tracking, then the persons monitoring the blasting event may be aware of both the identity of the blast operator under duress, and his/her location.

Under extreme circumstances, one can envisage a scenario where a finger of a blast operator is removed by a terrorist with intent to use a blasting apparatus for illicit purposes. To overcome such issues, a biometric analyzer may be used that is capable of scanning a biometric feature only from living tissue of a candidate blast operator. For example, the use of an RF scanning device to map the surface contours of a fingerprint may rely upon electrical properties of living tissue to generate a scanning image. Therefore, an RF scanning device may be particularly preferred for fingerprint scanning since it will be less capable of generating a scanned image in the presence of non-living tissue.

Regardless of the fingerprint scanning technique, it may be noted that fingerprint scanning may be more prone to complications imposed by the presence of dirt, or scars and cuts on the finger surface. To overcome such anomalies, fingerprint images derived from biometric scanning may be processed to improve image quality. Such processing may interpolate and smooth anomalies in the image to generate an image having a quality more suited for comparison with other biometric signatures. In most preferred embodiments, the fingerprint image may be scored in terms of its quality and accuracy, such that images that fail to meet or exceed basic image quality requirements are rejected. Such data or image processing to improve a 'quality' of a biometric signature may be applied to any form of biometric analysis other than fingerprint scanning.

Also within the scope of the present invention are blasting apparatuses that include GPS tags or devices associated with each biometric analyzer, each blasting machine, and/or the central command station. The blasting apparatus may be preprogrammed only to accept biometric signatures derived from scanning biometric features within a specific range of, or at a specific location compared to, the blasting machines and/or the central command station. For example, the blast authorizing means located at, near to or remote from the blast site may seek verification not only of the input biometric signature with known biometric signatures of authorized blast operators, but in addition the blast authorizing means may also seek verification of the current geographical co-ordinates of the candidate blast operator with those geographical co-ordinates expected or pre-assigned to the blasting event.

In another embodiment, the invention encompasses the use of a portable device to be carried by a candidate blast operator, for storing information relating to the blast operator, including for example information relating to the biometric features or the biometric signature of the blast operator. In this way, the data stored on the portable device may be transferred to other components of the blasting apparatus for processing.

Preferably, the portable device may further include a biometric analyzer such that the candidate blast operator inputs his or her biometric feature(s) directly onto the portable device. More preferably, the portable device further includes a blast authorizing means to allow the decision regarding whether the blast operator is an authorized blast operator to be made on the portable device, rather than by an integral component of the blast apparatus. For example, the device may further comprise a database of known biometric signatures of authorized blast operators. In this way, a candidate blast operator may present himself or herself to input biometric features into the blasting system. However, these features will be detected by and processed by the portable device. The decision regarding whether the candidate blast operator is authorized to control the blasting apparatus may then be read directly off the portable device, for example by placing the portable device into one or more appropriate reader units associated with the blasting system. For example, such a reader unit may be associated with one or more components of the blasting apparatus including but not limited to the blasting machines and/or the central command station. In this way, the biometric signature of the candidate blast operator may be maintained on the portable device, which may be 'blanked' (i.e. all biometric feature and biometric signature data erased) on a routine basis. In addition, the database comprising biometric features is preferably maintained on the portable device, rather than residing in a permanent central database remote from the blast site, which may be more susceptible to unauthorized access and abuse.

In particularly preferred embodiments, the portable device may take the form of a "smart-card". More preferably, the smart card may take the form of a credit-card shaped device that can be easily carried by a blast operator. For example, each smart card may include the identification of the blast operator on the card, together with an electronic memory for storing information relating to the biometric features or the biometric signature of the blast operator. The card may then be read by an appropriate card reader, associated for example with one or more components of a blast apparatus or at a position remote from the blast site, in communication with either the central command station or a blasting machine. In preferred embodiments, each smart card may include a biometric analyzer to retrieve biometric data from a blast operator, and preferably process the biometric data to generate a biometric signature. For example, a blast operator may present himself or herself to an appropriate authority prior to a blasting event, and in the presence of the appropriate authority insert his/her smart card into a suitable smart card reader, to verify the nature of the biometric information stored on the smart card. In other embodiments, the smart card may further include a database of authorized biometric signatures, such that all processes to generate a biometric signature, and for comparing the signature with those of authorized blast operators, can be completed by the smart card even prior to insertion of the smart card into the reader. Preferably, the reader only retrieves an "authorized" or "not authorized" message from the smart card, such that the blasting apparatus is activated or deactivated accordingly.

The use of a smart card (or indeed any portable device) where the database is maintained thereupon, avoids the need for a separate database for example in a remote location. This presents the advantage that the biometric signatures, and the personal privacy and security of those signatures, are retained by each blast operator on a personal device, perhaps making them less prone to interception and abuse by unauthorized persons seeking to retrieve biometric information for breeching privacy or for illicit purposes. In this regard, the database can be written and removed from a smart card or equivalent device as required.

It will be appreciated that the smart card system may be used in conjunction with any of the embodiments described herein. In preferred embodiments, the smart card (or other portable device) may further include a GPS device, such that the location of the smart card, the blast operator, or the place in which the blast operator input his/her biometric information into the device, can be recorded. As previously discussed, such location information may be stored for future use, or may be used to determine whether the blast operator is in a desired (or required) position to warrant activation of the blasting apparatus.

In further embodiments, a smart card (or other portable storage device) may be used in conjunction with a security PIN, or other form of alphanumeric or numeric code. For example, to activate one or more components of a blasting apparatus of the present invention, a blast operator may be required to input a biometric feature into the apparatus via one or more smart cards, and also input a specific PIN code into one or more components of the blasting apparatus for activation thereof. Each PIN code may be specific for the blast operator, may be specific for a particular blasting event, or may be specific for a particular blast operator/blasting event combination.

The present invention encompasses blasting apparatuses that can be associated with detonators. However, the present invention further encompasses blasting apparatuses that include detonators for use in conjunction with the other components of the blasting system.

Other embodiments of the present invention relate to methods of controlling detonators at a blast site that employ the blasting apparatuses of the present invention. For example, with reference to FIG. 3, in one embodiment the invention provides for a method of controlling a plurality of detonators at a blast site, the method comprising the steps of:

- establishing a blasting apparatus according, for example according to an embodiment of the invention described with reference to FIG. 1 (and variants thereof) at the blast site (step 50);
- scanning at least one biometric feature of a candidate blast operator via said at least one biometric analyzer (step 51);
- processing information derived from scanning said at least one biometric feature via said blast authorizing means, to generate a biometric signature (step 52);
- comparing said biometric signature with known biometric signatures via said blast authorization means, and if said biometric signature matches any one of said known biometric signatures of authorized blast operators (step 53);
- activating the blasting apparatus to enable transmission of said at least one command signal to said at least one detonator (step 54). Failure to identify a biometric signature derived from an authorized user can result either in the blasting apparatus retaining a generally inactive state (55), or resorting to a "safe" or shutdown mode (56).

Figure 4:
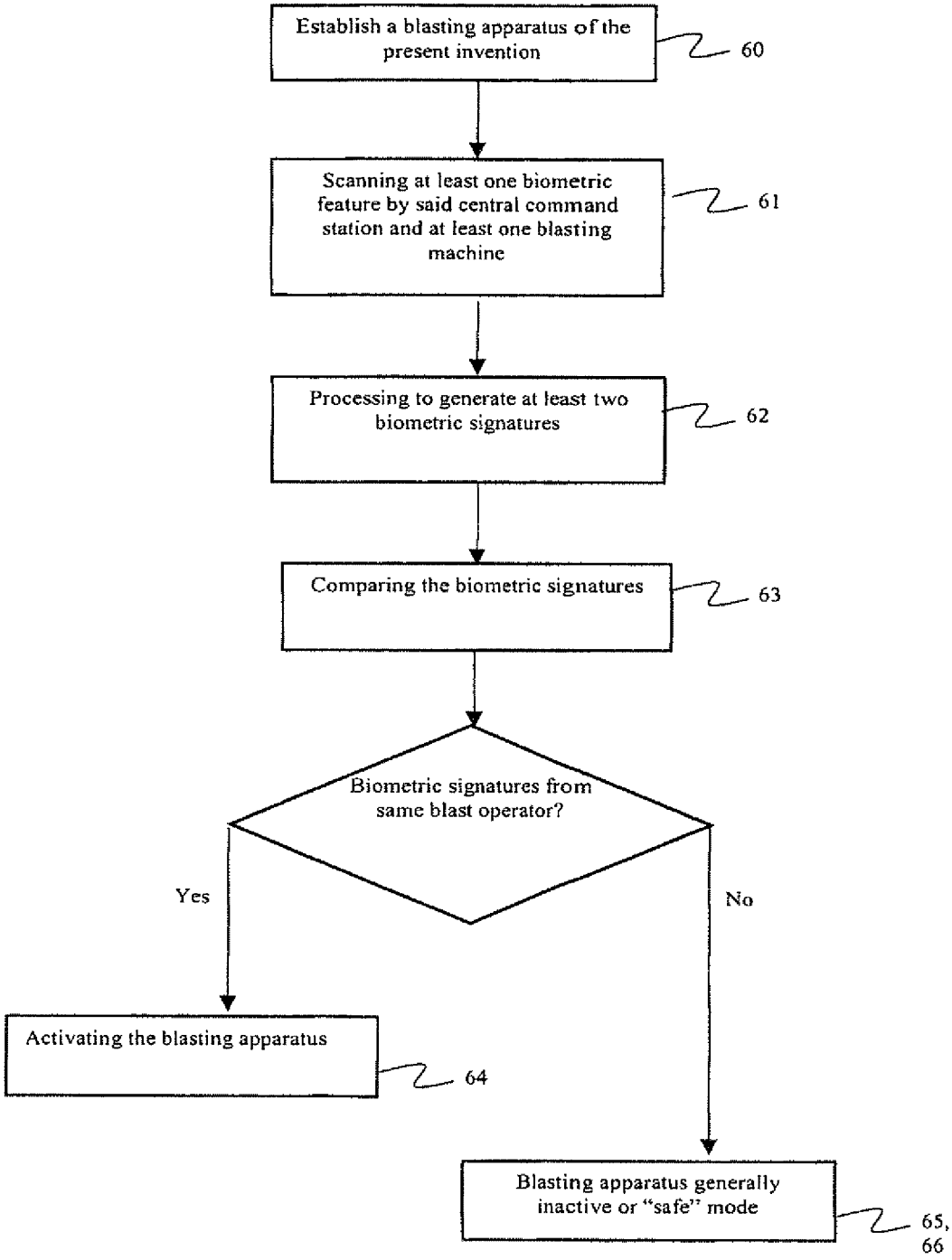
FIG. 4 is a flow chart of a method for blasting of one embodiment of the present invention.
Figure 5:
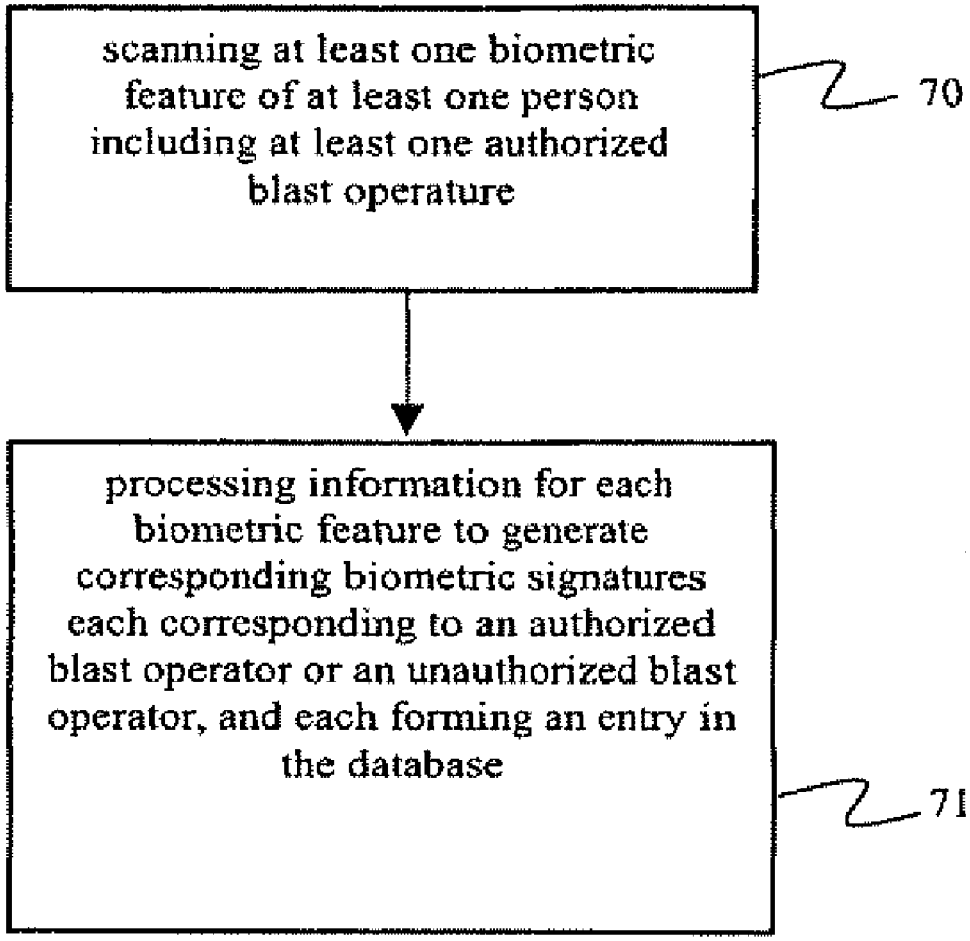
FIG. 5 is a flow chart of a method for blasting of one embodiment of the present invention.

With reference to FIG. 4, another embodiment the invention provides for a method of controlling a plurality of detonators at a blast site, the method comprising the steps of:

- establishing a blasting apparatus according, for example to an embodiment of the invention described with reference to FIG. 2 (and variants thereof) at the blast site (step 60);
- scanning at least one biometric feature of a blast operator via each biometric analyzer associated with said central command station and each of said at least one blasting machine (step 61);
- processing information derived from scanning said at least one biometric feature via each blast authorizing means associated with said central command station and each of said at least one blasting machine, to generate at least two biometric signatures (step 62);
- comparing said at least two biometric signatures to determine whether said biometric signatures are derived from the same blast operator (step 63), and if so; and
- activating the blasting apparatus to enable transmission of said at least one command signal to said at least one detonator (step 64). Failure to identify at least two biometric signatures derived from the same blast operator can result either in the blasting apparatus retaining a generally inactive state (65), or resorting to a "safe" or shutdown mode (66).

Figure 3:
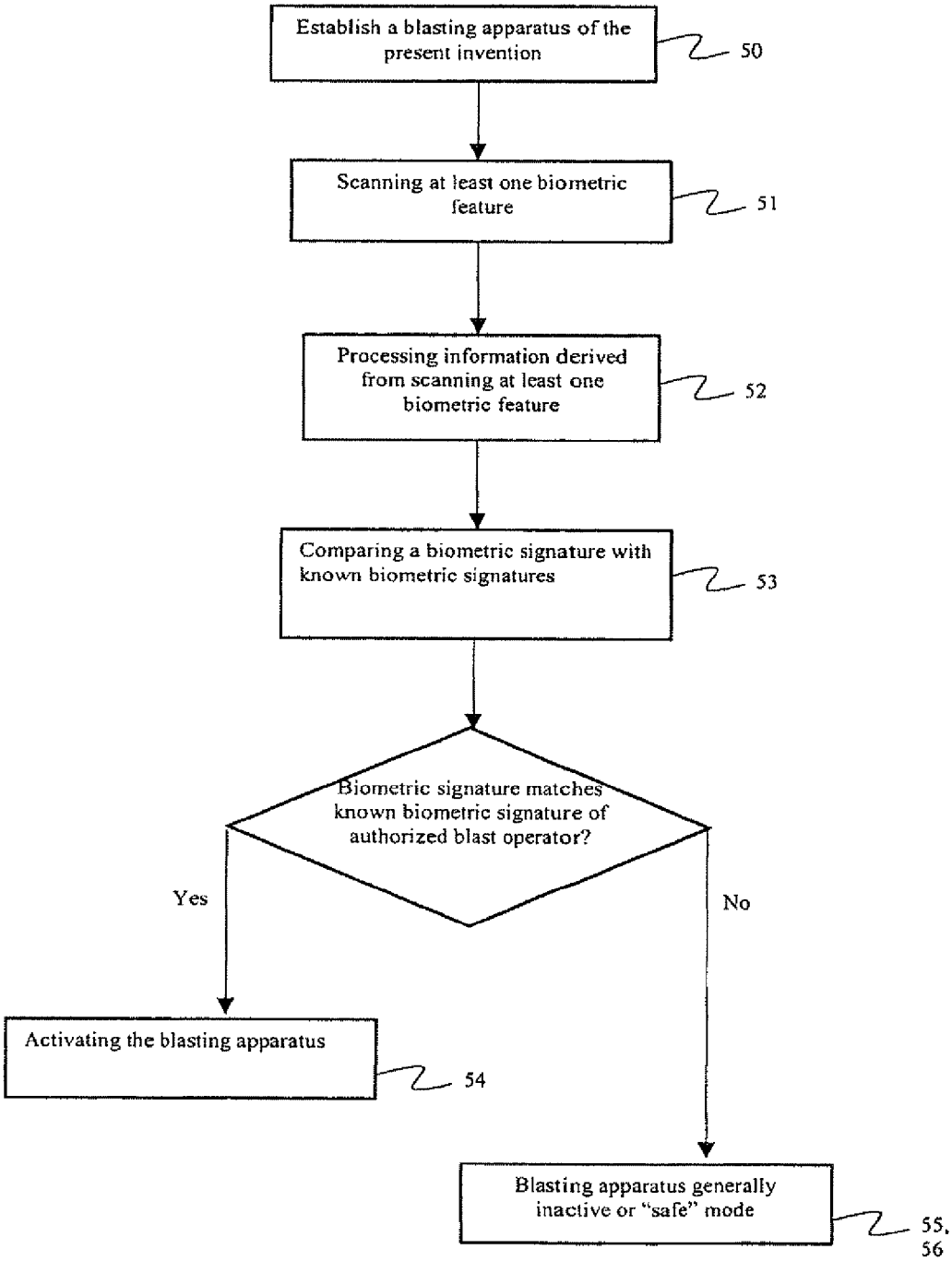
FIG. 3 illustrates a blasting apparatus of one embodiment of the present invention.

It is within the scope of the present invention to employ both of methods outlined with reference to FIGS. 3 and 4, at the same time or subsequent to one another during any attempt to control a blasting apparatus of the invention and/or to execute a blasting event. Moreover, other methods that are encompassed by the invention over and above those described with reference to FIGS. 3 and 4 may be combined with one or more of the methods described with reference to FIGS. 3 and 4.

In another embodiment of the present invention, there is provided a method for generating a database for use in identifying a presence of an authorized blast operator, the method comprising the steps of scanning at least one biometric feature of at least one person including at least one authorized blast operator in step 70;

processing information for each biometric feature to generate corresponding biometric signatures each corresponding to an authorized blast operator or an unauthorized blast operator, and each forming an entry in the database in step 71.

Preferably, step 71 further includes determining whether each biometric signature has a quality that meets or exceed a predetermined quality threshold, such that those biometric signatures that fail to meet or exceed said threshold are rejected.

Whilst the invention has been described with reference to specific embodiments of the detonators, blasting apparatuses, and methods of blasting of the present invention, a person of skill in the art would recognize that other detonators, blasting apparatuses, and methods of blasting that have not been specifically described would nonetheless lie within the spirit of the invention. It is intended to encompass all such embodiments within the scope of the appended claims.

The invention claimed is:

1. A blasting apparatus for use by a blast operator to control at least one detonator at a blast site, the blasting apparatus comprising:

optionally, a central command station for generating and transmitting at least one command signal;

if the central command station is present, at least one blasting machine, and if the command station is not present, at least two blasting machines, for generating or receiving at least one command signal, optionally processing, and transmitting said at least one command signal to said at least one detonator;

at least two biometric analyzers, the central command station, if present, and each blasting machine being associated with a corresponding biometric analyzer for recording information regarding at least one biometric feature of a candidate blast operator;

at least two blast authorizing means, each of said at least two blast authorizing means being associated with a corresponding biometric analyzer and receiving and processing said recorded biometric feature information to generate a biometric signature in the central command station, if present, or the blasting machine corresponding to the blast authorizing means; and comparison means to compare biometric signatures generated by the at least two blast authorizing means, and enable said blasting apparatus to actuate said at least one detonator upon identification of at least two biometric signatures from the at least two blast authorizing means that are determined to have been derived from the same blast operator.

2. The blasting apparatus of claim 1, wherein the comparison means compares a biometric signature derived from a blast authorizing means associated with said central command station with a blast authorizing means associated with at least one blasting machine.

3. The blasting apparatus of claim 2, wherein said comparison means is associated with said central command station, each blasting machine including means to transmit each biometric signature generated by each associated blast authorizing means to said central command station.

4. The blasting apparatus of claim 2, wherein said comparison means is associated with said at least one blasting machine, said central command station including means to transmit a biometric signature generated by an associated blast authorizing means to each of said at least one blasting machine.

5. The blasting apparatus of claim 1, wherein each blast authorizing means transmits information regarding each biometric signature to a central database.

6. The blasting apparatus of claim 5, wherein the central database is located in the central command station, if the central command station is present.

7. The blasting apparatus of claim 5, wherein the central database is located in the at least one blasting machine.

8. The blasting apparatus of claim 5, wherein the central database is located in one of the at least two blasting machines.

9. A method of controlling a plurality of detonators at a blast site, the method comprising the steps of:

establishing a blasting apparatus of claim 1 at the blast site;

scanning at least one biometric feature of a blast operator via each biometric analyzer associated with said central command station (if present) and said at least one blasting machine;

processing information derived from scanning said at least one biometric feature via each blast authorizing means, to generate at least two biometric signatures;

comparing said at least two biometric signatures to determine whether said biometric signatures are derived from the same blast operator, and if so; and causing the blasting apparatus to adopt or maintain an active state suitable for actuation of said at least one detonator.

* * * * *